US005287561A

United States Patent [19]

Spector

[11] Patent Number: 5,287,561

[45] Date of Patent: Feb. 22, 1994

[54] CONVERTIBLE FABRIC HAT AND PACKAGE THEREFOR

[76] Inventor: Donald Spector, 380 Mountain Rd., Union City, N.J. 07087

[21] Appl. No.: 7,918

[22] Filed: Jan. 22, 1993

Related U.S. Application Data

[63] Continuation-in-part of Ser. No. 840,022, Feb. 24, 1992, which is a continuation-in-part of Ser. No. 793,190, Nov. 13, 1991, Pat. No. 5,135,222, which is a continuation-in-part of Ser. No. 743,279, Aug. 9, 1991, which is a continuation-in-part of Ser. No. 345,405, May 1, 1989, Pat. No. 5,138,721, which is a continuation-in-part of Ser. No. 205,477, Jun. 13, 1988, Pat. No. 4,834,382.

[51] Int. Cl.[5] ..... A42B 1/00

[52] U.S. Cl. ..... 2/209.11; 2/175.1; 273/DIG. 17; 446/27; 446/46

[58] Field of Search ..... 2/171, 175, 195, 196, 2/209.1, DIG. 3, DIG. 10; 273/138 R, DIG. 17, 424; 446/27, 46, 48, 225

[56] References Cited

U.S. PATENT DOCUMENTS

| | | | |
|---|---|---|---|
| 1,111,659 | 9/1914 | Le Pierre | 2/175 |
| 1,426,402 | 8/1922 | Moore | 2/195 |
| 1,699,133 | 1/1929 | Bullard | 2/175 |
| 2,615,168 | 10/1952 | Tannenbaum | 2/196 |
| 3,009,162 | 11/1961 | Hori | 446/27 |
| 3,345,646 | 10/1967 | McCann | 273/DIG. 17 |
| 3,758,985 | 9/1973 | Heisler | 446/46 |
| 4,262,911 | 4/1981 | Opresik | 446/46 |
| 4,580,990 | 4/1986 | Avery | 446/46 |
| 5,045,011 | 9/1991 | Lovik | 446/46 |

*Primary Examiner*—Clifford D. Crowder
*Assistant Examiner*—Diana L. Biefeld

[57] ABSTRACT

A fabric hat which is usable as such by a child and is also convertible into a flying play object that can be thrown and caught in the manner of a Frisbee. The fabric hat is formed by a pair of dome-shaped sections, one nested within the other to define the crown of the hat, the circular rims of the sections being joined to an annular disc defining the brim of the hat. To convert the hat into a flying object, a toy balloon in its collapsed state is inserted through a port in one of the sections into a space between the sections. The balloon is then inflated to transform the crown into a ball encircled at its equator by the annular disc, whereby the resultant flying object can then be thrown and caught. The hat is packaged in a two-ply display card whose front ply has a circular opening therein through which the crown projects, the shorter rear ply having an arcuate indentation that matches a corresponding portion of the opening. The brim of the hat is clamped between the plies whereby a child may try on the hat without, however, having to remove it from the display card.

6 Claims, 3 Drawing Sheets

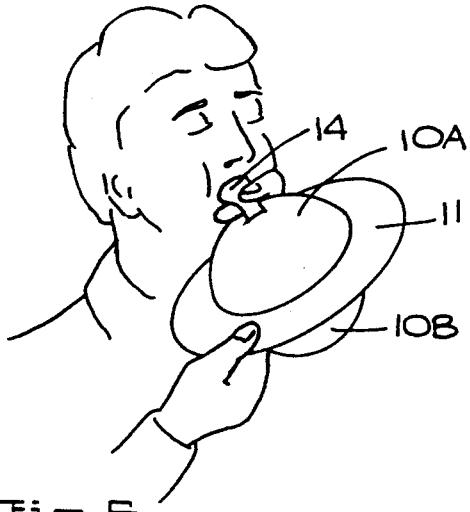
Fig. 6
Fig. 4
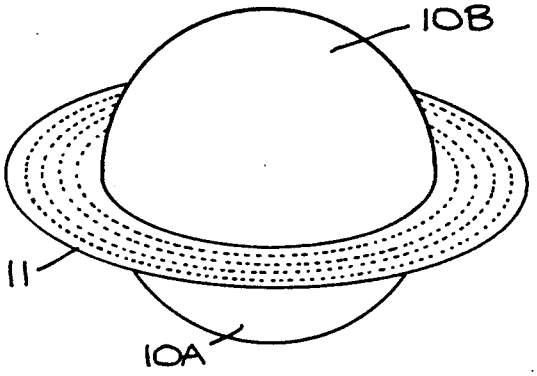
Fig. 7
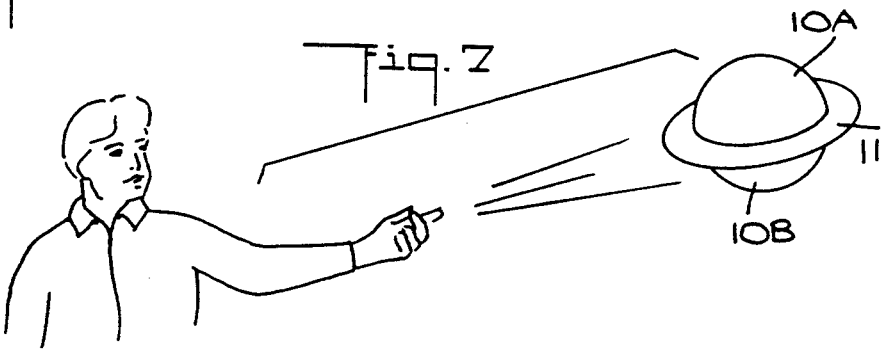
Fig. 5
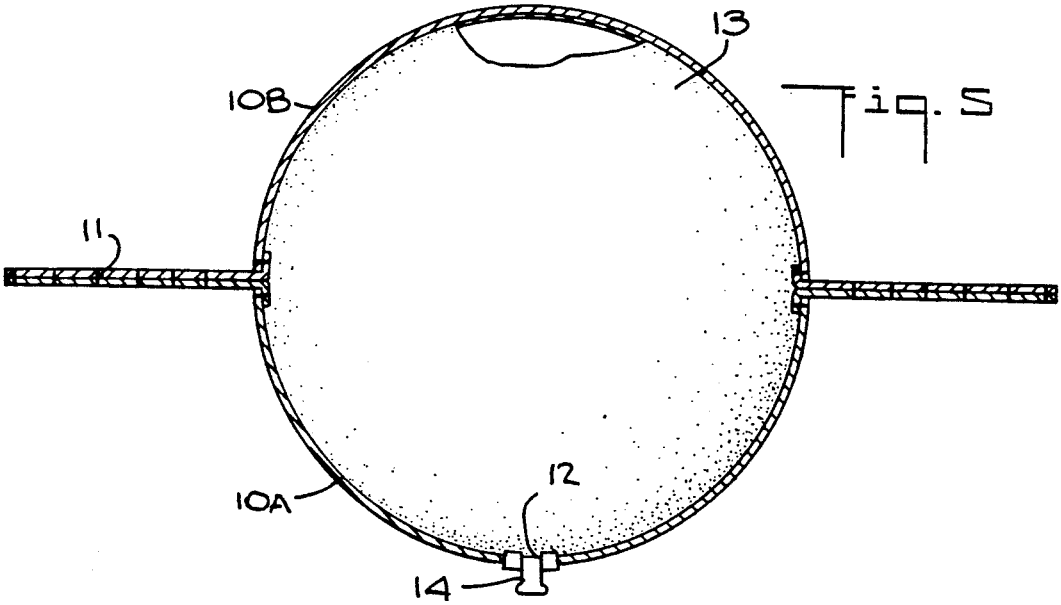

Fig. 8
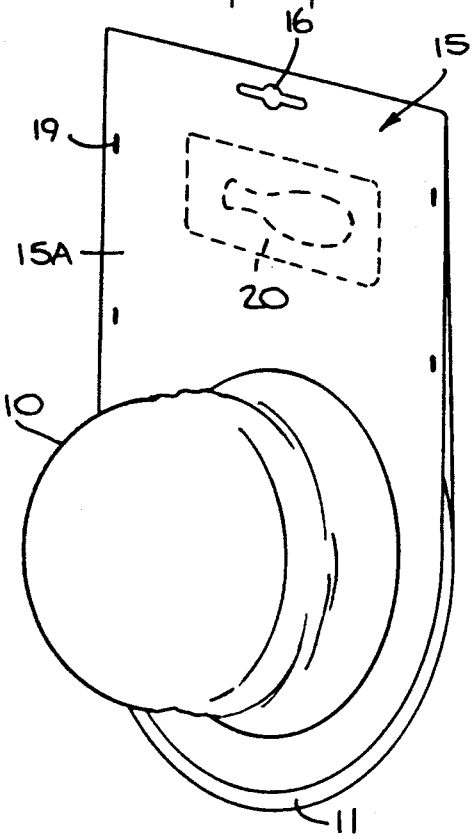
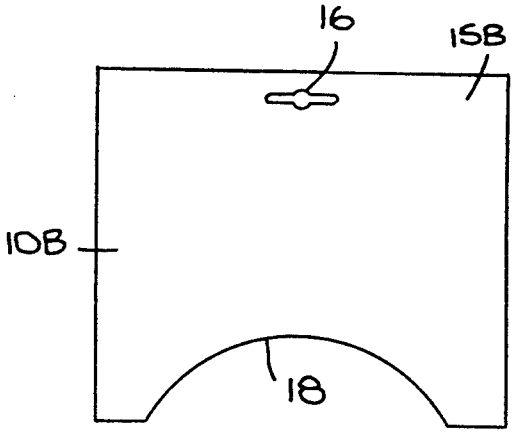
Fig. 11
Fig. 9
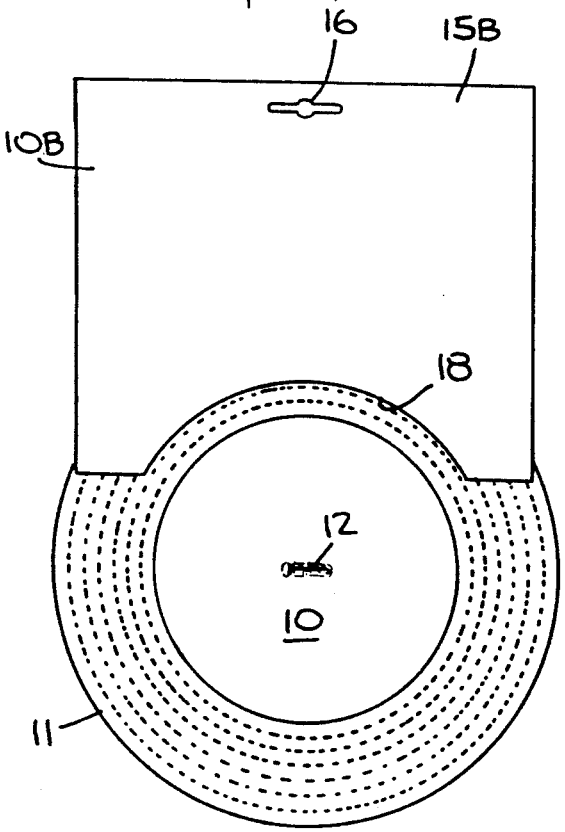
Fig. 10
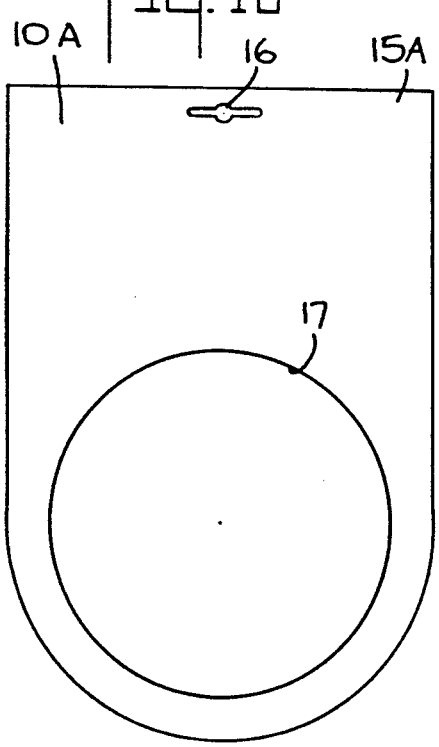

CONVERTIBLE FABRIC HAT AND PACKAGE THEREFOR

RELATED APPLICATIONS

This application is a continuation-in-part of my copending application Ser. No. 840,022, filed Feb. 24, 1992, entitled "Figurative Toy Missile," which is a continuation-in-part of my patent application Ser. No. 793,190, filed Nov. 13, 1991, entitled "Multi-Mode Playball" (now U.S. Pat. No. 5,135,222), which is a continuation-in-part of patent application Ser. No. 743,279, filed Aug. 9, 1991, entitled "Variable-Weight Play Ball" (now U.S. Pat. No. 4,917,381), which in turn is a continuation-in-part of patent application Ser. No. 345,405, filed May 1, 1989, entitled "Pneumatic Bolster" (now U.S. Pat. No. 5,138,721), this being a continuation-in-part of a still earlier patent application Ser. No. 205,477, filed Jun. 13, 1988, entitled "Inflatable Play Ball" (now U.S. Pat. No. 4,834,382). The entire disclosures of these prior applications are incorporated herein by reference.

BACKGROUND OF INVENTION

1. Field of Invention

This invention relates to a fabric hat that is usable as such by a child and is also convertible into a flying play object that can be thrown and caught in the manner of a Frisbee, the fabric hat being so packaged that it can be tried on without removing the hat from its package.

2. Status of Prior Art

My prior patent, U.S. Pat. No. 4,834,382 (Spector) discloses a pneumatic play ball having an outer casing formed of non-stretchable fabric material which when fully expanded assumes a ball configuration. Within the casing is an inflatable balloon whose stem initially projects through a small port in the casing. When the balloon is inflated, it expands to engage and conform to the inner surface of the casing, after which the stem is tied and pushed within the port whereby the balloon is then fully encased.

Balloon balls of the type disclosed in my prior patent have a form which is strictly utilitarian, and the flight characteristics of these balls are not very different from conventional light-weight or weighted balls. And while it is possible for the thrower to impart a spin to a conventional ball so that it rotates in the course of its flight, one cannot usually see this spin.

In my copending application Ser. No. 840,022, there is disclosed a flying toy missile formed by an outer fabric casing that encloses a rubber balloon which is inflated with water or with air and water so that it then functions as a weighted ball, the casing having fabric appendages. When a player grasps this missile by one or more of its appendages and then throws it, the missile will spin or execute other movements in flight.

Also of prior art interest is the well-known FRISBEE toy, which is a plastic disc that can be thrown and caught by players, the disc spinning in the course of flight.

Children have always been fascinated by so-called unidentified flying objects or UFO's which often take the form of saucer-shaped objects that descend to earth from outer space. But a conventional Frisbee does not resemble a flying object from outer space.

While a hat for a child is seemingly unrelated to a play piece, a child who takes a ball, a Frisbee or a flying toy of some sort to a beach or play area, is well advised on a hot, sunny day to wear a broad brimmed hat to protect his head from the sun. A fabric hat for this purpose is preferred, for it can be rolled up or crushed and stored in a pocket. Since the fewer things a child carries to the beach or a play area, the fewer he is likely to lose, a fabric hat which is convertible to a flying object has distinct advantages; for while a child can toss his hat in the air, there is not much fun in doing so.

A purchaser for a toy for a child normally wishes to examine the toy before deciding whether to buy it. While the box in which the toy is packaged usually carries a picture of the toy, this picture does not give a potential purchaser adequate information, for he has no assurance that what is contained in the box exactly corresponds to the pictured toy. Yet because of the possibility of theft, it is not good practice for a toy retail establishment to stock unpackaged toys which potential purchasers are free to examine.

In order to facilitate examination, toy packages are now available having open fronts which permit a customer to view and touch the toy which is entrapped within the package so that the toy cannot be removed. And with smaller toys, use is now made of so-called bubble packaging, such as a display card which can be suspended from a hook, the toy being enclosed within a transparent plastic bubble bonded to the card. This makes it possible to view the toy without having to remove it from its package.

However, a novelty hat for a child which is to be sold in a toy store presents a special problem; for even if the hat is packaged in a box having a transparent plastic window, it is not possible for a child to try on the hat to see whether it fits his head without first removing it from its package. And this he is not free to do without first purchasing the hat.

SUMMARY OF INVENTION

In view of the foregoing, the main object of this invention is to provide a fabric hat which is usable as such by a child and is also convertible into a flying play object that can be thrown and caught in the manner of a Frisbee.

More particularly, an object of the invention is to provide a convertible hat of the above type which in its hat mode has a dome-shaped crown and a broad annular brim that protects the wearer from the sun, and in its flying object mode resembles a rotating planet in which the hat brim then creates what appears to be an orbital ring.

Also an object of the invention is to provide a convertible hat which in its flying-object mode takes the form of a spherical ball having an equatorial annular disc imparting to the flying object the flight characteristics of a disc-like Frisbee.

Yet another object of this invention is to provide a variable-weight flying object whose flight characteristics can be altered by changing the weight of the object simply by adding water thereto.

A significant feature of the invention is that the flying hat, which is woven of natural or synthetic fibers, may be printed or silk screened in multi-colored decorative patterns to render the hat highly attractive. When, however, the hat is transformed into a flying object which spins in flight, the decorative pattern imparts an altogether different appearance to the object.

Yet another object of the invention is to provide a package for the hat in the form of a display card in which the hat is entrapped, the crown of the hat being fully exposed so that a child can try on the hat without removing it from the display card. An advantage of this packaging is that a potential purchaser can see and try on the hat before purchasing it.

Briefly stated, these objects are attained in a fabric hat which is usable as such by a child and is also convertible into a flying play object that can be thrown and caught in the manner of a Frisbee. The fabric hat is formed by a pair of dome-shaped sections, one nested within the other to define the crown of the hat, the circular rims of the sections being joined to an annular disc defining the brim of the hat. To convert the hat into a flying object, a toy balloon in its collapsed state is inserted through a port in one of the sections into a space between the sections.

The balloon is then inflated to transform the crown into a ball encircled at its equator by the annular disc, whereby the resultant flying object can then be thrown and caught. The hat is packaged in a two-ply display card whose front ply has a circular opening therein through which the crown projects, the shorter rear ply having an arcuate indentation that matches a corresponding portion of the opening. The brim of the hat is clamped between the plies whereby a child may try on the hat without, however, having to remove it from the display card.

BRIEF DESCRIPTION OF DRAWINGS

For a better understanding of the invention as well as other objects and further features thereof, reference is made to the following detailed description to be read in conjunction with the accompanying drawings, wherein:

FIG. 4 shows the flying play object resulting from conversion of the hat;

FIG. 5 is a section taken in the diametrical plane of the flying object;

FIG. 6 shows the child blowing up a balloon to transform the hat into the flying object;

FIG. 7 shows the child throwing the flying object;

FIG. 8 is a perspective view of a display card in accordance with the invention for packaging the hat;

FIG. 9 is a rear view of the display card;

FIG. 10 separately shows the front ply of the display card; and

FIG. 11 separately shows the rear ply of the display card.

DESCRIPTION OF INVENTION

Hat Mode

Figure 1:
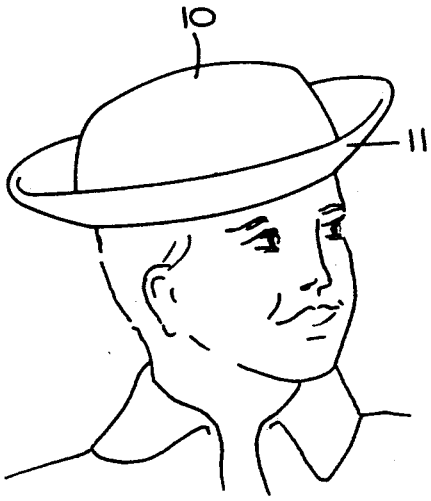
FIG. 1 shows a child wearing a hat in accordance with the invention.
Figure 3:
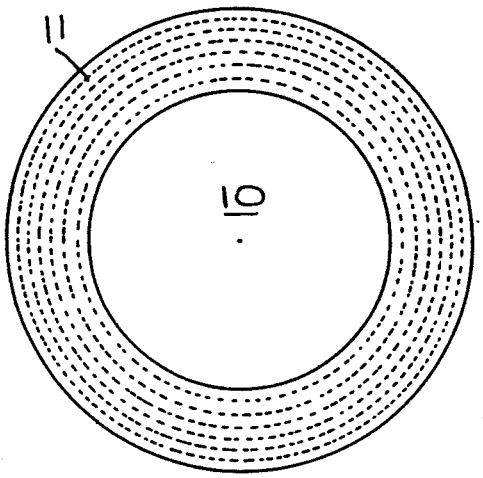
FIG. 3 is a plan view of the hat.

A fabric hat in accordance with the invention is designed to be worn by a child in the manner illustrated in FIG. 1. While the hat is convertible into a flying play object, FIGS. 1 to 3 illustrate the hat only in its hat mode.

The fabric hat is woven or otherwise fabricated of natural or synthetic fibers. It is constituted by a crown, generally designated by numeral 10, and an annular disc defining a brim 11 extending outwardly from the rim of the crown. The brim is relatively broad so as to shield the wearer's face from the sun. Brim 11 is normally planar, but it may be turned up, as shown in FIG. 1, or turned down.

Figure 2:
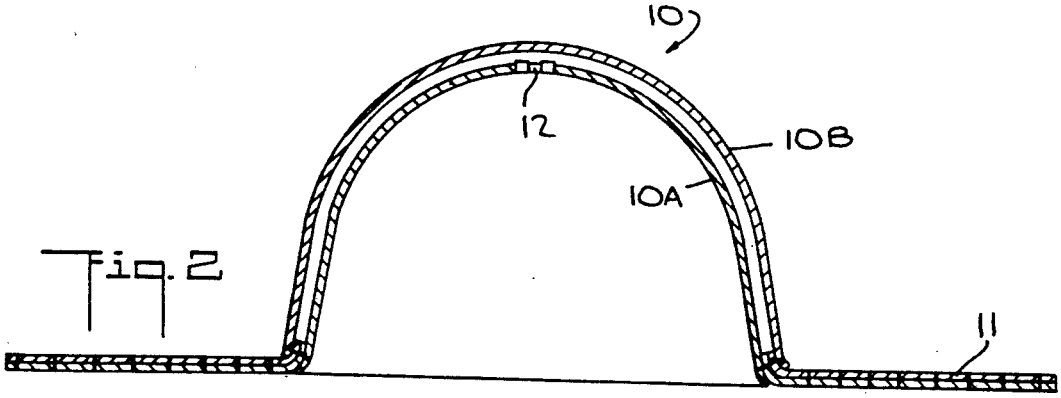
FIG. 2 is a longitudinal section taken through the hat.

As shown in FIG. 2, crown 10 is created by a pair of dome-shaped sections 10A and 10B having a generally hemispherical form. Section 10A is nested within section 10B so that section 10A functions as the inner liner of the crown. The rims of sections 10A and 10B are sewn or otherwise joined to the inner periphery of annular brim 11.

Fabric sections 10A and 10B may be created by interfitted contoured pieces of non-stretchable fabric which are sewn together. But if the fabric pieces are woven of thermoplastic synthetic fibers, then the pieces may be seamed together ultrasonically. In practice, brim 11 may be made by two superposed annular plies, one being a flange extension of inner section 10A of the crown, the other a flange extension of outer section 10B, the two superposed plies of the brim being sewn together. Such sewing is preferably effect by a series of concentric thread lines which act to somewhat stiffen the brim so that it is not wavy.

Figure 2A:
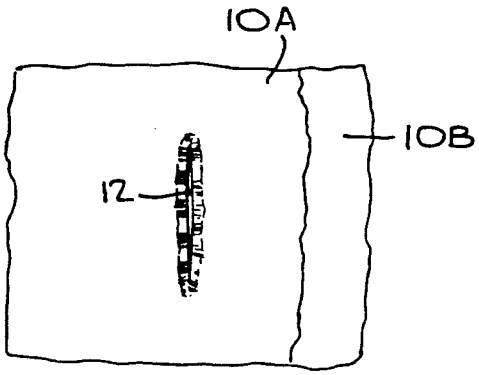
FIG. 2A shows a portion of the inner section of the crown of the hat.

As best seen in FIG. 2A, inner section 10A of the crown is provided with a small slit 12 whose borders are reinforced with tightly coiled cotton or nylon threading as in a reinforced buttonhole. Hence, slit 12 can be made with a standard buttonhole machine. Slit 12 is normally closed, but can be dilated to create a port to admit a collapsed rubber balloon, as will later be described.

Flying Object Mode

When the hat shown in its hat mode in FIG. 1 is converted to its flying object mode, it assumes the form shown in FIG. 4 in which inner and outer sections 10A and 10B of the crown together create the outer fabric casing of a spherical ball which is encircled about its equator by annular disc 11, which in the hat mode forms the brim of the hat.

The transformation from the hat mode to the flying object mode is effected by a rubber balloon 13 in the manner shown in FIGS. 5 and 6. This balloon, which is provided with a tubular stem 14 for mouth inflation, is inserted into a space between the inner and outer sections 10A and 10B of the crown through slit 12, the stem projecting from the slit. The balloon is then blown up by the child so that it conforms to the inner surface of the outer fabric of which the casing is formed is non-stretchable, it confines the stretched rubber skin of the balloon so that the balloon assumes the same form as the casing.

After being blown up, the stem of the balloon is tied and pushed under slit 12 so that the balloon is then fully encased, and the resultant ball is fairly hard and its fabric casing is free of creases.

An inflated rubber balloon is easily punctured and notoriously weak in other respects. Indeed, one of the pleasures of playing with balloons is to burst and explode them. As a balloon is being inflated, its rubber skin stretches and the skin which is thin to begin with becomes even thinner until a point is reached in the expanding diameter of the balloon where the skin is ruptured by the internal pressure, at which point the balloon bursts.

But in the present arrangement, the air-inflated balloon is confined within a substantially non-stretchable casing so that regardless of how roughly the flying object is handled, the confined balloon is not permitted to stretch beyond a point at which it may rupture. In practice, some water may be added to the balloon to enhance the weight of the flying object and to modify its flight characteristics.

In playing with the flying object, a child may, a shown in FIG. 7, hold it by brim 11 and throw it as he would a flying disc or Frisbee, to cause the flying object to spin as it flies. And the object can be caught by its brim in the same manner as a frisbee.

In flight, the flying object resembles a rotating planet having an orbital ring, as shown in FIG. 7. The surface of the fabric may be printed or silk-screened with multicolored decorative patterns so that in the hat mode the hat is highly attractive or colorful. When the hat is in the flying object mode, the decorative patterns then spin in flight to produce an altogether different spatial effect which enhances the appeal of the object in flight.

Packaging

In order to protectively package the hat in its hat mode so that it can be displayed in a retail store, use is made of a display card 15, as shown in FIGS. 8 to 11. This card permits a child who is interested in acquiring the hat to try it on to determine whether it fits his head and to see how it looks when worn without, however, having to first remove the hat from the card.

Card 15 is formed of two plies, a front ply 15A and a rear ply 15B, both made of cardboard. A center slot 16 die cut into the card at its upper end makes it possible to suspend the display card on a hook.

Front ply 15A, as shown separately in FIG. 10, is generally rectangular in form, the lower section of the card being rounded and having a circular opening 17 therein whose diameter is somewhat greater than the diameter of crown 10 of the hat but smaller than the diameter of hat brim 11. Rear ply 10B is also rectangular in form and has the same width as the front ply, but is shorter in length. The rear ply is provided at its lower end with an arcuate indentation 18 whose curvature matches the corresponding portion of the circular opening 17 in the front ply.

The hat is placed between the front and rear plies so that crown 10 of the hat projects through opening 17 in front ply 15A, and brim 11 of the hat is clamped between the plies. The front and rear plies may be stapled together at the edges by staples 19 so as to retain between the plies a small, flat transparent plastic envelope 20 containing one or more balloons in their collapsed condition.

Thus, a perspective purchaser, seeing the display card, can remove it from its hook, and without removing the hat from the card, fit it onto his head, for the interior of the crown is open. When the hat is purchased, the purchaser can then remove it from the card and also remove envelope 20. Then when the wearer of the hat wishes to transform it into a flying object, he has only to insert a collapsed balloon through slit 12 into the space between the inner and outer sections of the crown and blow up the balloon in the manner previously described.

It is not essential to the invention that the dome-shaped sections of the hat have a hemispherical shape, but only that they have matching shapes. Hence, if the shape is somewhat conical, the crown of the hat will be similarly conical and the ball created in the flying object made will have a double cone formation.

While there has been shown and described a preferred embodiment of a convertible fabric hat and a package therefor, it will be appreciated that many changes and modifications may be made therein without, however, departing from the essential spirit thereof.

I claim:

1. A fabric hat and balloon combination which is convertible into a flying play object that can be thrown and caught like a Frisbee, said convertible fabric hat and balloon combination comprising:

(a) a pair of dome-shaped sections, each having a circular rim, one nested within the other to define a hat crown having an inner liner, one of said sections having a slit therein;

(b) a rubber balloon provided with a stem, said balloon in a collapsed state being disposed in a space between said sections with the stem projecting from the slit;

(c) an annular disc joined at its inner periphery to the rims of the sections to define a hat brim, said hat being convertible by inflating said balloon through said stem to blow up the balloon to transform the crown into a ball whose equator is encircled by said annular disc to create said flying object, after which the stem is tied and pushed under the slit.

2. A fabric hat and balloon combination as set forth in claim 1, in which the sections and the crown are formed of tightly woven fabric.

3. A fabric hat and balloon combination as set forth in claim 2, in which the crown sections are formed of contoured fabric pieces which are sewn together.

4. A fabric hat and balloon combination as set forth in claim 1, in which said disc is formed of two superposed plies which are sewn together, one extending outwardly from the rim of one section of the crown, the other, from the rim of the other section.

5. A fabric hat and balloon combination as set forth in claim 1, wherein said sections have a hemispherical form an said ball is spherical.

6. A fabric hat and balloon combination as set forth in claim 1, in which water is added to the balloon to impart weight to the ball.

* * * * *